US006502358B2

(12) United States Patent
Smythe, Jr.

(10) Patent No.: US 6,502,358 B2
(45) Date of Patent: Jan. 7, 2003

(54) DRYWALL FINISHING OUTSIDE CORNER END-CAPS

(76) Inventor: Timothy D. Smythe, Jr., 4017 Northcliff, Bend, OR (US) 97701

( * ) Notice: Subject to any disclaimer, the term of this patent is extended or adjusted under 35 U.S.C. 154(b) by 90 days.

(21) Appl. No.: 09/844,300

(22) Filed: Apr. 27, 2001

(65) Prior Publication Data

US 2001/0039775 A1 Nov. 15, 2001

Related U.S. Application Data

(60) Provisional application No. 60/201,181, filed on May 2, 2000.

(51) Int. Cl.[7] ..... E04B 2/00

(52) U.S. Cl. ..... 52/287.1; 52/254; 52/716.1

(58) Field of Search ..... 52/287.1, 288.1, 52/254, 255, 716.1, 717.04, 364, 631

(56) References Cited

U.S. PATENT DOCUMENTS 3,955,677 A * 5/1976 Collingwood ..... 206/453
5,253,456 A 10/1993 Todd ..... 52/11
5,505,032 A 4/1996 Wasserman et al. ..... 52/287.1
5,615,530 A * 4/1997 Kartler ..... 52/745.09
5,647,182 A * 7/1997 Rutherford ..... 52/287.1
5,775,314 A 7/1998 Michael et al. ..... 124/86
5,960,958 A 10/1999 Michaud et al. ..... 206/599
6,148,573 A 11/2000 Smythe, Jr. ..... 52/255
6,219,987 B1 4/2001 Trent et al. ..... 52/716.1

* cited by examiner

*Primary Examiner*—Carl D. Friedman
*Assistant Examiner*—Naoko Slack
(74) *Attorney, Agent, or Firm*—Clifford Kraft

(57) ABSTRACT

Drywall endcaps of the type that mate with drywall seam finishing material. The endcaps can be square or bullnose and cap the ends of exterior corners with either three 90 degree or other exterior angles, or two 90 degree or other exterior angles and one 90 degree or other interior angle. The endcaps can be made of two or three laminate layers with an inner layer that faces wallboard and a rigid or semi-rigid layer that can be optionally tapered. The semi-rigid layer can be high impact plastic. An optional outer layer is of fibrous material and is prepared to directly receive paint or texture.

16 Claims, 5 Drawing Sheets

DRYWALL FINISHING OUTSIDE CORNER END-CAPS

This application is based on, and claims priority from, U.S. Provisional Patent Application No. 60/201,181 filed on May 2, 2000. That application is incorporated by reference.

BACKGROUND

1. Field of the Invention

This invention relates generally to the field of drywall installation and more particularly to drywall endcaps for exterior drywall corners.

2. Description of Related Art

The use of gypsum drywall board in modern construction is well known. Manufactured drywall sheets are nailed to studs to form interior walls and ceilings. Before these sheets can be painted or textured, the joints must be taped and sealed with joint sealing compound (drywall mud). Taping (known as stringing) is a tedious process since first tape and mud must be dispensed with a tool known as a bazooka, then the worker rolls and glazes the tape while the mud is wet. As the tape strings out, it has a tendency to pull in the direction of motion.

Many seams are finished with an old product known as flex bead. This is first attached over the seam and coated with drywall mud. After the mud is dry, it is sanded and finished, and then painted or textured.

A new system of interior and exterior flex-trim material has been invented that can be constructed from a laminate of paper-plastic-paper that is finished as soon as it is installed (see U.S. Pat. No. 6,148,573). This material can be beveled so that its edges can be "killed" with a small amount of drywall mud and a wide blade, or other, tool. This leads to a finished seam or corner with the material blending into the drywall sheet. The finished seam or corner is ready to paint or texture as soon as the mud drys.

Using this new technology with outside corners leaves a perfect drywall corner except that the top corner is unfinished. What is badly needed is a junction piece similar to the new technology to complete the corner.

SUMMARY OF THE INVENTION

The present invention relates to a system of endcaps that are used to finish exterior corners making outer 90 degree angles or exterior corners making one interior 90 degree angle. The corners can be square or bullnose and can be made to mate with two or three pieces of the flex-trim type technology. While 90 degrees is given as an example, any angle is possible. The corners can be laminate or single layer pieces that have an outside surface prepared to receive paint or texture. The corners can have tabbed edges that adhere to drywall mud for contact with drywall and built up members that can be tapered to match any taper in the flex trim product and to merge into the surrounding drywall. In the case where the endcaps of the present invention are laminar, they can be made of two or three layers of material. The inner layer can be a material made to contact drywall and to stick to wet drywall mud. This can be any fibrous material, in particular drywall paper. The next layer can be semi-rigid durable material such as high impact plastic which can be tapered to a thin edge. The surface of the plastic can be prepared to directly receive paint or texture, or there can be a third layer in the laminate which can be a fibrous material like cup stock paper or any other material capable of directly receiving paint or texture.

BRIEF DESCRIPTION OF THE DRAWINGS

For a more complete understanding of this invention, reference should now be made to the embodiments illustrated in greater detail in the accompanying drawings and described below by way of examples of the invention.

It should be understood, of course, that the invention is not necessarily limited to the particular embodiments illustrated herein.

DESCRIPTION OF PREFERRED EMBODIMENTS

Figure 1:
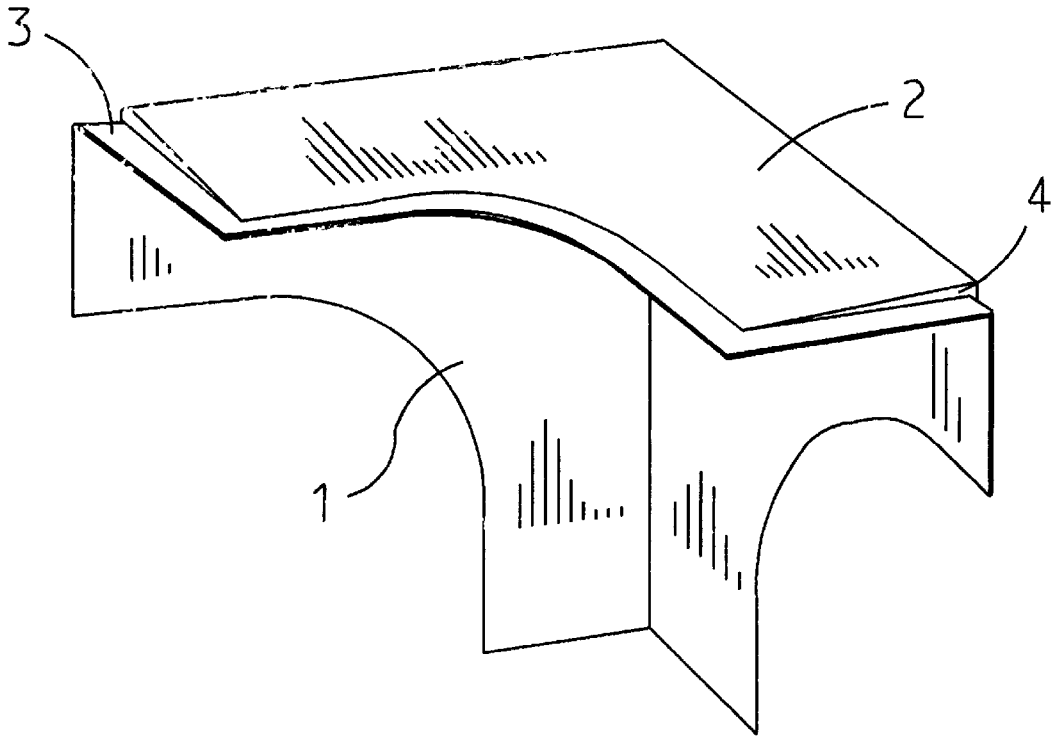
FIG. 1 shows a pointed exterior corner endcap with an exterior angle.

Turning to FIG. 1, an exterior corner square endcap is seen. By square is meant not bullnose. The corner shown in FIG. 1 is pointed. An interior surface 1 mates with drywall. This surface extends beyond, or is shaped to extend beyond, a finished member 2 which can receive paint or texture directly. This extension 3 forms a tab that allows a flex trim product to lie directly on top of the tab forming a finished corner. The member 2 can have a optionally tapered edge 4 to match the tapering of the flex trim product. The entire piece can be formed from a single piece of material like plastic, or the piece can be a two or three layer laminate. The preferred method is to continuously form the piece as a three layer laminate with a semi-rigid interior member made of high impact polystyrene or other impact resistive material, the outer layer made of fibrous material like cup-stock paper that can directly receive paint or texture, and an inner layer of fibrous material like wallboard paper that can mate with the wallboard; the three layers should be continuously bonded during manufacture. They can be bonded with glue, or continuously extruded together.

Figure 2:
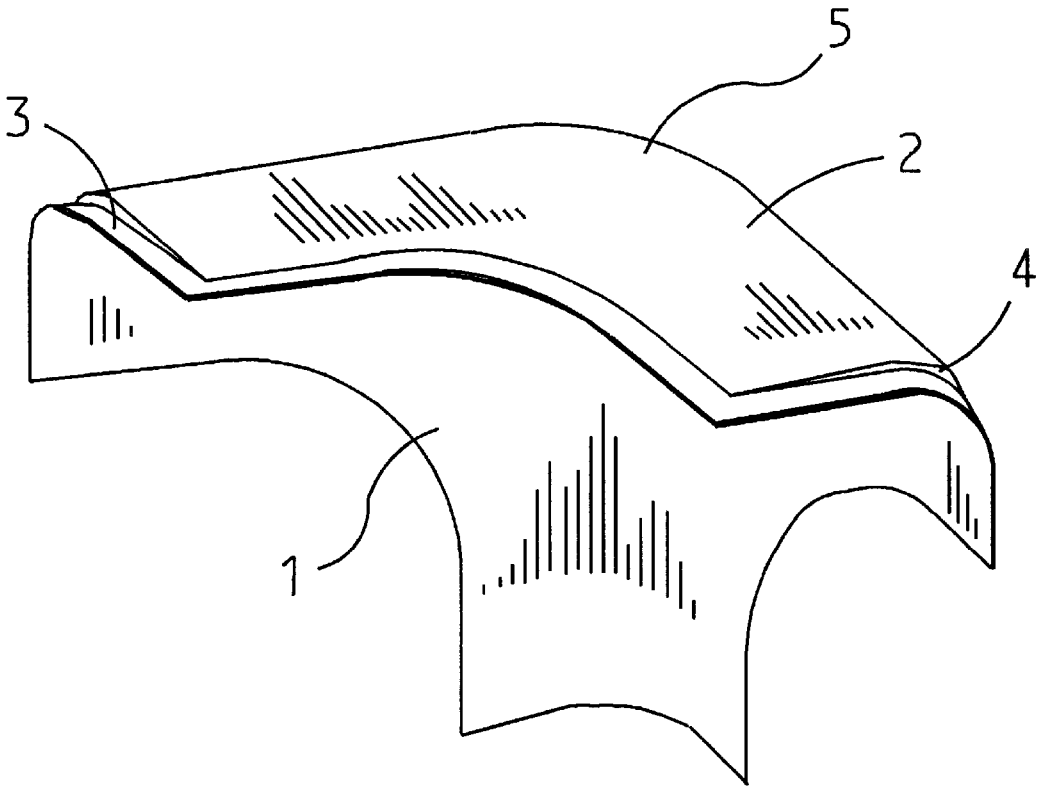
FIG. 2 shows a bullnose exterior corner endcap with an exterior angle

FIG. 2 shows a bullnose version of the piece of FIG. 1. All features are the same except the rounded bull nose. This is curved to match the bullnose curvature of a bullnose flex trim piece.

Figure 3:
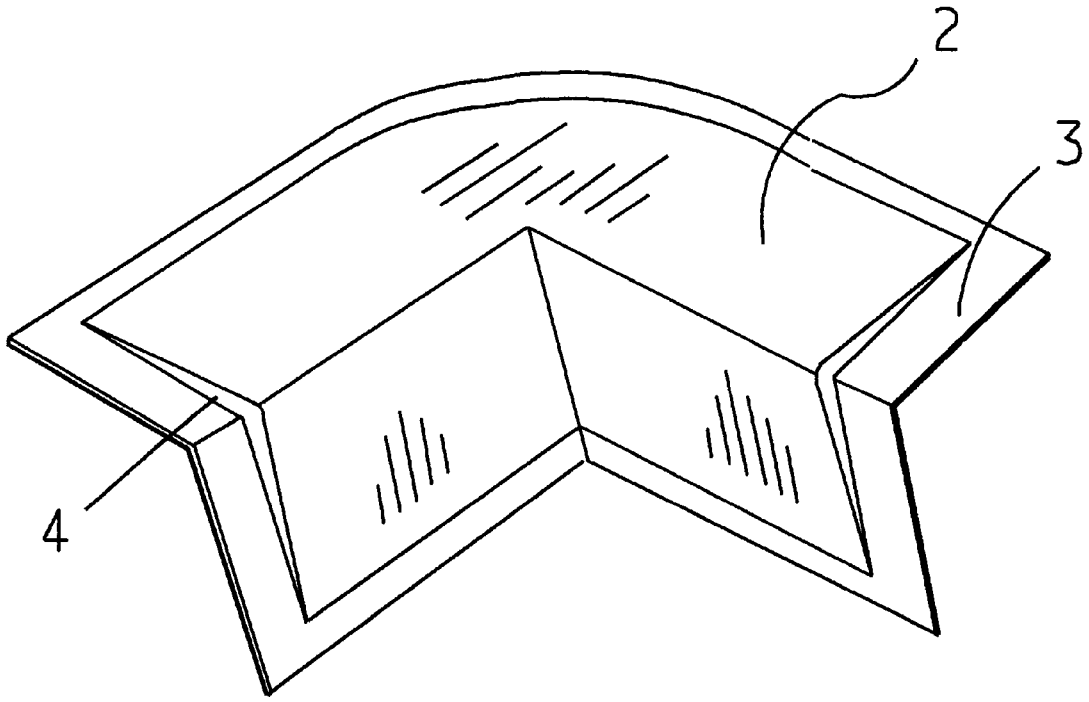
FIG. 3 shows a pointed exterior corner endcap with an interior angle.

FIG. 3 shows a square exterior endcap designed to match an exterior corner with one interior angle. By the word square, I mean not bullnose. This piece matches two pieces of flex trim material. Again edges 3 extend beyond the finished surface 2 to form a tab like arrangement.

Figure 4:
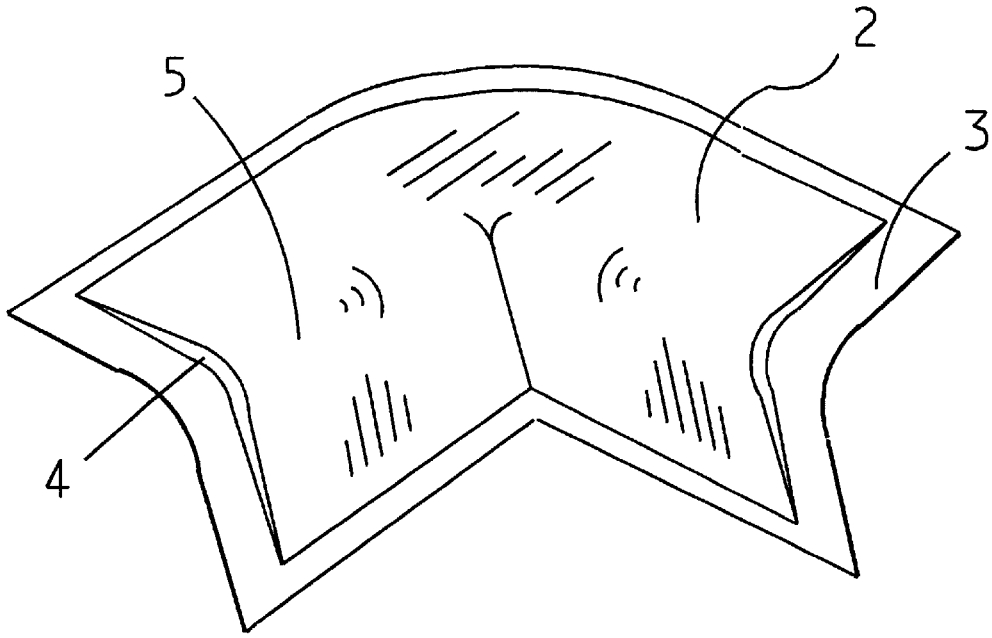
FIG. 4 shows a bullnose exterior corner endcap with an interior angle.

FIG. 4 shows the piece of FIG. 3 in a bullnose configuration with a curved bullnose surface 5 clearly seen. In all cases of FIGS. 1–4, the exposed outer surface is prepared to receive paint or texture directly either by roughening, or by having a layer of fibrous material that can hold paint or texture. All pieces can be laminates made up of paper or fibrous material and a rigid material like high impact plastic.

Figure 5:
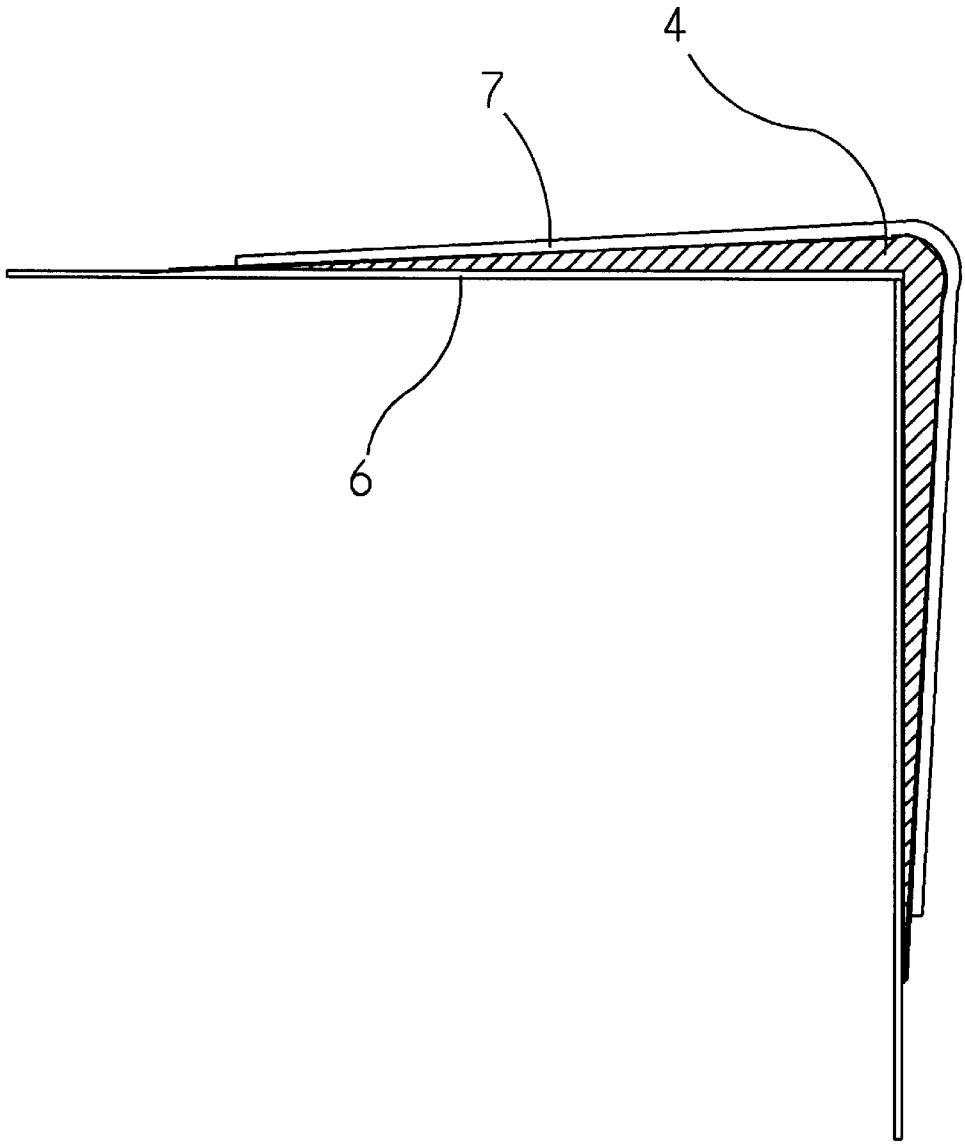
FIG. 5 shows a cross section of a 3-layer laminate corner.

FIG. 5 shows a cross section of one of the pieces from FIGS. 1–4. An inner layer 6 of fibrous material such as wallboard paper can be seen. This layer 6 touches the drywall. An interior rigid or semi-rigid member 4 can also be seen. This can be high impact polystyrene or other high impact material or plastic. An outer layer of fibrous material 7 can also be seen. This layer is optional. It is of a material and is finished in order to directly receive paint or texture.

The preferred material is cup-stock paper; however, any material capable of directly receiving paint or texture can be used. This layer 7 can be omitted. In that case, the semi-rigid layer 4 can have its outer surface finished to directly receive paint or texture. This can be accomplished by roughing the surface or other means.

The embodiments shown are merely examples of the concepts of the present invention. Many other examples and embodiments are possible within the scope of the present invention.

I claim:

1. A drywall endcap for finishing outside drywall corners comprising:

a continuous semi-rigid member forming a 3-way outside corner, said member preformed into 3 orthogonal side panels, said side panels forming a pointed corner;

said side panels having 3 sets of connecting edges for joining with elongated flex-trim pieces and 3 sets of wallboard edges for merging into surrounding wallboard, said connecting edges being L-shaped to continue L-shaped flex-trim pieces into said exterior corner, said wallboard edges being tapered to a thin edge for merging into said surrounding wallboard, said L-shaped connecting edges alternating with said tapered wallboard edges;

said side panels having interior and exterior surfaces, said interior surfaces facing said surrounding wallboard;

a first layer of fibrous material continuously bonded to said exterior surfaces, said fibrous material prepared to directly receive paint or texture;

a second layer of fibrous material continuously bonded to said interior surfaces, said second layer of fibrous material extending beyond said semi-rigid member to form a tab, said second layer of fibrous material in contact with said surrounding wallboard.

2. The drywall endcap of claim 1 wherein said first layer of fibrous material is wallboard paper.

3. The drywall endcap of claim 1 where said second layer of fibrous material is cupstock paper.

4. The drywall endcap of claim 1 wherein said semi-rigid member is high-impact plastic.

5. A drywall endcap for finishing outside drywall corners comprising:

a continuous semi-rigid member forming a 3-way outside corner, said member preformed into 3 orthogonal side panels, said side panels formed into a rounded exterior corner;

said side panels having 3 sets of connecting edges for joining with elongated flex-trim pieces and 3 sets of wallboard edges for merging into surrounding wallboard, said connecting edges being arcuate shaped to continue arcuate shaped flex-trim pieces into said exterior corner, said wallboard edges being tapered to a thin edge for merging into said surrounding wallboard, said arcuate shaped connecting edges alternating with said tapered wallboard edges;

said side panels having interior and exterior surfaces, said interior surfaces facing said surrounding wallboard;

a first layer of fibrous material continuously bonded to said exterior surfaces, said fibrous material prepared to directly receive paint or texture;

a second layer of fibrous material continuously bonded to said interior surfaces, said second layer of fibrous material extending beyond said semi-rigid member to form a tab, said second layer of fibrous material in contact with said surrounding wallboard.

6. The drywall endcap of claim 5 wherein said first layer of fibrous material is drywall paper.

7. The drywall endcap of claim 5 wherein said second layer of fibrous material is cupstock paper.

8. The drywall endcap of claim 5 wherein said semi-rigid member is high-impact plastic.

9. A drywall endcap for finishing outside drywall corners comprising:

a continuous semi-rigid member forming a exterior corner with an interior angle, said interior angle having an acute side and an obtuse side, said member preformed into 2 orthogonal side panels and a top panel orthogonal to said side panels, said side panels and said top panel meeting at a sharp edge, said top panel extending away from said side panels on the obtuse side of said interior angle;

said side panels having 2 sets of connecting edges for joining with elongated flex-trim pieces and 3 sets of wallboard edges for merging into surrounding wallboard, said connecting edges being L-shaped to continue L-shaped flex-trim pieces into said exterior corner, said wallboard edges being tapered to a thin edge for merging into said surrounding wallboard;

said side panels having interior and exterior surfaces, said interior surfaces facing said surrounding wallboard.

10. The drywall endcap of claim 9 wherein said semi-rigid member is high-impact plastic.

11. A drywall endcap for finishing outside drywall corners comprising:

a continuous semi-rigid member forming a exterior corner with an interior angle, said interior angle having an acute side and an obtuse side, said member preformed into 2 orthogonal side panels and a top panel orthogonal to said side panels, said top panel meeting said side panels at a rounded edge, said top panel extending away from said side panels on the obtuse side of said interior angle;

said side panels having 2 sets of connecting edges for joining with elongated flex-trim pieces and 3 sets of wallboard edges for merging into surrounding wallboard, said connecting edges being arcuate shaped to continue arcuate shaped flex-trim pieces into said exterior corner, said wallboard edges being tapered to a thin edge for merging into said surrounding wallboard;

said side panels having interior and exterior surfaces, said interior surfaces facing said surrounding wallboard.

12. The drywall endcap of claim 11 wherein said semi-rigid member is high-impact plastic.

13. A drywall endcap for finishing outside drywall corners comprising:

a continuous semi-rigid member forming a 3-way outside corner, said member preformed into 3 orthogonal side panals, said side panels forming a pointed corner;

said side panels having 3 sets of connecting edges for joining with elongated flex-trim pieces and 3 sets of wallboard edges for merging into surrounding wallboard, said connecting edges being L-shaped to continue L-shaped flex-trim pieces into said exterior corner, said wallboard edges being tapered to a thin edge for merging into said surrounding wallboard, said L-shaped connecting edges alternating with said tapered wallboard edges;

said side panels having interior and exterior surfaces, said interior surfaces facing said surrounding wallboard.

14. The drywall endcap of claim 13 wherein said semi-rigid member is high impact plastic.

15. A drywall endcap for finishing outside drywall corners comprising:

a continuous semi-rigid member forming a 3-way outside corner, said member preformed into 3 orthogonal side panels, said side panels formed into a rounded exterior corner;

said side panels having 3 sets of connecting edges for joining with elongated flex-trim pieces and 3 sets of wallboard edges for merging into surrounding wallboard, said connecting edges being arcuate shaped to continue arcuate shaped flex-trim pieces into said exterior corner, said wallboard edges being tapered to a thin edge for merging into said surrounding wallboard, said arcuate shaped connecting edges alternating with said tapered wallboard edges;

said side panels having interior and exterior surfaces, said interior surfaces facing said surrounding wallboard.

16. The drywall endcap of claim 15 wherein said semi-rigid member is high impact plastic.

* * * * *